US012115422B2

(12) United States Patent
Milleman et al.

(10) Patent No.: US 12,115,422 B2
(45) Date of Patent: Oct. 15, 2024

(54) MULTI-MATERIAL SCREW WEIGHT

(71) Applicant: KARSTEN MANUFACTURING CORPORATION, Phoenix, AZ (US)

(72) Inventors: Travis D. Milleman, Portland, OR (US); Cory S. Bacon, Cave Creek, AZ (US); Les J. Bryant, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/896,009

(22) Filed: Feb. 13, 2018

(65) Prior Publication Data

US 2018/0229091 A1 Aug. 16, 2018

Related U.S. Application Data

(60) Provisional application No. 62/458,215, filed on Feb. 13, 2017.

(51) Int. Cl.
*A63B 53/06* (2015.01)
*A63B 53/04* (2015.01)

(52) U.S. Cl.
CPC ..... *A63B 53/0475* (2013.01); *A63B 53/0466* (2013.01); *A63B 53/047* (2013.01); *A63B 2053/0479* (2013.01); *A63B 2053/0491* (2013.01)

(58) Field of Classification Search
CPC ..... A63B 2053/0491; A63B 534/0475; A63B 53/0466; A63B 53/047; A63B 53/0479
USPC ..... 473/334–339
See application file for complete search history.

(56) References Cited

U.S. PATENT DOCUMENTS 1,113,371 A * 10/1914 Pajeau ..... A63H 33/101 403/176
4,213,613 A * 7/1980 Nygren ..... A63B 53/04 473/332
6,077,171 A * 6/2000 Yoneyama ..... A63B 60/00 473/291
6,773,360 B2 * 8/2004 Willett ..... A63B 60/02 473/409
7,186,190 B1 * 3/2007 Beach ..... A63B 53/06 473/335
7,670,235 B2 * 3/2010 Lo ..... A63B 60/02 473/332
7,744,484 B1 * 6/2010 Chao ..... A63B 60/02 473/409
7,771,290 B2 * 8/2010 Bezilla ..... A63B 60/02 473/335
7,771,291 B1 * 8/2010 Willett ..... A63B 53/0466 473/345

(Continued)

FOREIGN PATENT DOCUMENTS

CN 103520891 1/2014
DE 102011122663 7/2013

(Continued)

*Primary Examiner* — Alvin A Hunter

(57) ABSTRACT

Embodiments of golf club heads having weights with two or more parts are described herein. The weight with two or more parts described herein provides a series of interchangeable parts of the overall weight to increase or decrease the weight to specific integers of weight. The two or more parts can comprise a first part with a first specific gravity and a second part with a second specific gravity. The second specific gravity is greater than the first specific gravity.

11 Claims, 3 Drawing Sheets

(56) References Cited

U.S. PATENT DOCUMENTS

| | | | | |
|---|---|---|---|---|
| 7,922,600 | B1 * | 4/2011 | Ambrose | A63B 60/00 473/338 |
| 7,927,231 | B2 | 4/2011 | Sato et al. | |
| 8,192,302 | B2 * | 6/2012 | Knutson | A63B 53/0466 473/335 |
| 8,540,589 | B2 * | 9/2013 | Bezilla | A63B 53/04 473/335 |
| 8,753,227 | B1 * | 6/2014 | Cackett | F16B 35/06 473/335 |
| 8,777,774 | B1 * | 7/2014 | Kim | A63B 53/047 473/336 |
| 8,998,747 | B2 | 4/2015 | Cackett et al. | |
| 9,259,627 | B1 * | 2/2016 | Myers | A63B 53/04 |
| 9,289,661 | B2 | 3/2016 | Stites et al. | |
| 9,388,842 | B2 * | 7/2016 | Dawson | A63B 53/04 |
| 9,452,327 | B2 | 9/2016 | Willett et al. | |
| 2002/0160854 | A1 | 1/2002 | Beach et al. | |
| 2002/0137576 | A1 | 9/2002 | Dammen | |
| 2006/0142095 | A1 | 6/2006 | Glickman | |
| 2008/0039229 | A1 | 2/2008 | Lo | |
| 2009/0088268 | A1 * | 4/2009 | Elizondo | A63B 60/00 473/341 |
| 2009/0298611 | A1 * | 12/2009 | Bezilla | A63B 53/04 473/335 |
| 2009/0298612 | A1 | 12/2009 | Knutson et al. | |
| 2010/0323815 | A1 * | 12/2010 | Bezilla | A63B 53/0466 473/335 |
| 2012/0165115 | A1 * | 6/2012 | Matsunaga | A63B 53/04 473/336 |
| 2013/0053172 | A1 * | 2/2013 | Nivanh | A63B 53/06 473/335 |
| 2013/0303304 | A1 * | 11/2013 | Sato | A63B 60/00 473/338 |
| 2014/0243110 | A1 * | 8/2014 | Cackett | F16B 35/06 473/335 |
| 2014/0274446 | A1 * | 9/2014 | Greaney | A63B 53/0466 473/307 |
| 2015/0087439 | A1 | 3/2015 | Song | |

FOREIGN PATENT DOCUMENTS

| | | | | |
|---|---|---|---|---|
| JP | H10234902 | | 9/1998 | |
| JP | 2005160947 | A * | 6/2005 | A63B 53/0466 |
| JP | 2010234108 | | 10/2010 | |
| JP | 2013043091 | A * | 3/2013 | A63B 53/04 |
| JP | 2013233346 | A * | 11/2013 | A63B 53/0466 |

* cited by examiner

MULTI-MATERIAL SCREW WEIGHT

CROSS REFERENCE TO RELATED APPLICATIONS

This claims the benefit of U.S. Provisional Patent Appl. No. 62/458,215, filed on Feb. 13, 2017, the contents of which are fully incorporated herein by reference.

FIELD OF THE INVENTION

The present disclosure relates to a golf club head, specifically, a weight for a golf club head to adjust the swing weight.

BACKGROUND

Weights are used to adjust the swing weight of a golf club. Weighting the golf club changes the characteristics of center of gravity, moment of inertia, and flight path of the golf ball.

Many weights in current golf club heads require one material with a low density or one material with a high density. The limitation of one material weights restricts the range a weight one can use to change the characteristics of the club head. The use of high density weights have limitations and increases manufacturing costs. For example, threading a high density weight is difficult. In addition, when the high density weight is torqued down upon, the high density weight tends to crack and eventually break due to the brittleness of the material. Accordingly, there is a need in the art for a weight that provides the ease of threading a material with a low density material while having the flexibility of interchanging a high density material to achieve multiple weight ranges for the same design weight.

Figure 1A:
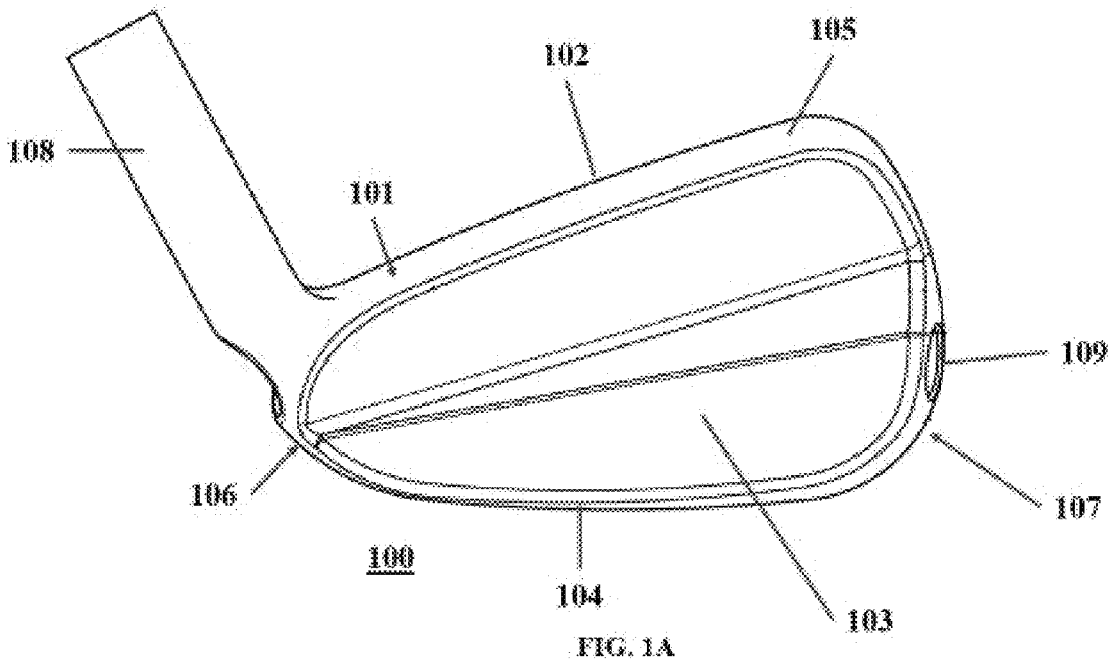
FIG. 1A depicts a back perspective view of an iron-type golf club head according to an embodiment.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with weights. The same reference numerals in different figures denote the same elements.

DETAILED DESCRIPTION

Described herein is a golf club head comprising a two or more part weight. The two or more part weight allows for a first low density material of less than or equal to 7.8 specific gravity or density to be combined with a second high density material of greater than 7.8 specific gravity or density. The first low density material of the weight serves to provide a more torque resistant part of the weight to enable threads to be incorporated for purpose of securing the two or more part weight into an aperture. One part of the weight can comprise a low density material, with a specific gravity or density less than 7.8. This part of the weight is more durable and can be used as a cap over the second part of the weight. The second part of the weight can comprise a second high density material, with a specific gravity or density greater than 7.8. The second part of the weight can be interchangeable. The two or more weight has the advantage of (1) reducing the stockpile of inventory that the supplier has to manufacture, (2) provide customizable weight screws to increase (or decrease) the weight to specific integers of weight, (3) the first low density part material is easier to paint and provides a stockpile of inventory of weights with a consistent surface finish and coloring scheme, and (4) the first low density part provides greater durability to the threads than the second part material because the threads comprise the more durable, less brittle first low density material.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements, but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling (whether mechanical or otherwise) may be for any length of time, e.g., permanent or semi-permanent or only for an instant.

The absence of the word "removably," "removable," and the like near the word "coupled," and the like does not mean that the coupling, etc. in question is or is not removable.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

A. Golf Club Head with Weight

Figure 1B:
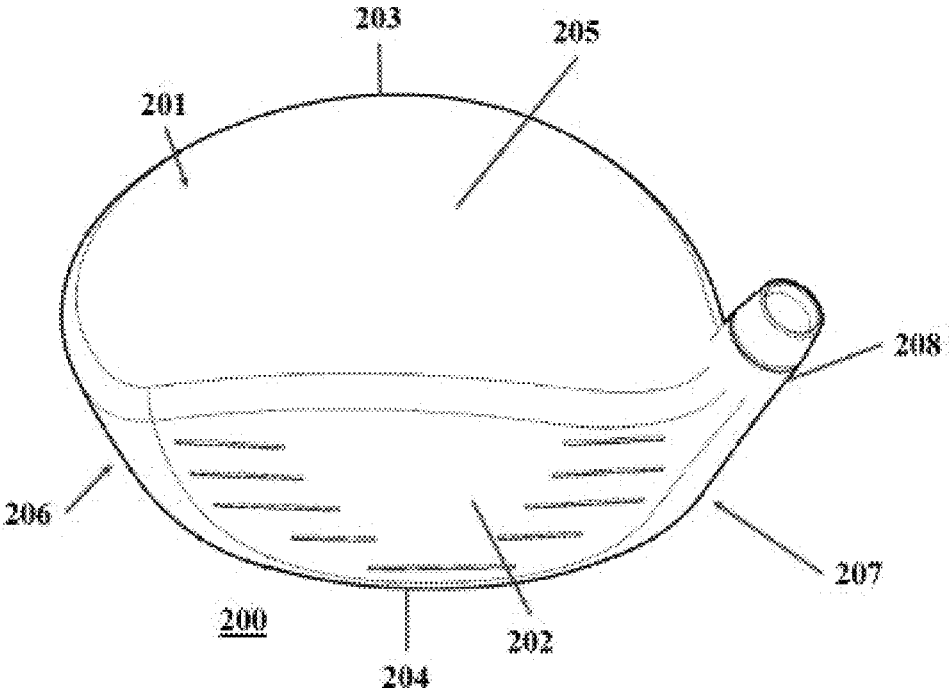
FIG. 1B depicts a front perspective view of a wood-type golf club head according to an embodiment.

In some embodiments, described herein is a golf club head 100 comprising a club head body 101 configured to receive a weight. The weight can be configured as weight 110 as described below. The golf club head 100 can be an iron-type golf club head (see FIG. 1). The club head body 101 can comprise a striking face 102, a rear 103 opposite the striking face 102, a sole 104, a top 105 opposite the sole 104, a heel region 106, a toe region 107, a hosel 108, and one or more apertures 109. The one or more apertures 109 seat, couple, or harbor weights 110 described below. In some embodiments, the golf club head 100 can comprise one, two, three, four, five, six, seven, eight, nine, or ten apertures 109 and one, two, three, four, five, six, seven, eight, nine, or ten weights 110. The weights 110 can be position in any region of the golf club head 100. In some embodiments, weights 110 can be position in the toe region 107, the heel region 106, the sole 104, the top 105, the rear 103, the hosel 108, or any combination thereof. In other embodiments, the weights 110 can be position in the toe region 107, and/or the heel region 106 of the club head body 101. In some embodiments, a weight 110 can be position in the toe region 107.

For ease of discussion and understanding, and for purposes of description only, the following detailed description illustrates golf club head 100 as an iron. It should be appreciated that the irons are provided for purposes of illustration of one or more embodiments of the multi-material weight as disclosed herein. However, the disclosed embodiments of the multi-material weight can be used on any desired wood, iron, hybrid, or other golf club where weights are desired. For example, the club head 100 may include, but is not limited to, a driver, a fairway wood, a hybrid, a one-iron, a two-iron, a three-iron, a four-iron, a five-iron, a six-iron, a seven-iron, an eight-iron, a nine-iron, a pitching wedge, a gap wedge, a utility wedge, a sand wedge, a lob wedge, and/or a putter.

In other embodiments, described herein is a golf club head 200 comprising a club head body 201 configured to receive a weight. The weight can be configured as weight 110 as described below. The golf club head 200 can be a wood-type golf club head (see FIG. 2). The club head body 201 can comprise a striking face 202, a rear 203 opposite the striking face 202, a sole 204, a top 205 opposite the sole 204, a heel region 206, a toe region 207, a hosel 208, and one or more apertures (not shown). The one or more apertures (not shown) seat, couple, or harbor weights 110 described below. In some embodiments, the golf club head 200 can comprise one, two, three, four, five, six, seven, eight, nine, or ten apertures and one, two, three, four, five, six, seven, eight, nine, or ten weights 110. The weights 110 can be position in any region of the golf club head 200. In some embodiments, weights 110 can be position in the toe region 207, the heel region 206, the sole 204, the top 205, the rear 203, the hosel 208, or any combination thereof. In other embodiments, the weights 110 can be position in the toe region 207, and/or the heel region 206 of the club head body 201. In some embodiments, a weight 110 can be position in the toe region 207.

The positions of the weights 110 in the golf club heads 100 and 200 allow for precise weighting to optimize the characteristics of center of gravity and moment of inertia. Optimizing the center of gravity and moment of inertia of golf club heads 100 and 200 allows for improvements to the performance characteristics of ball spin, forgiveness, and trajectory under various circumstances.

B. Weight with Two Materials

Figure 2A:
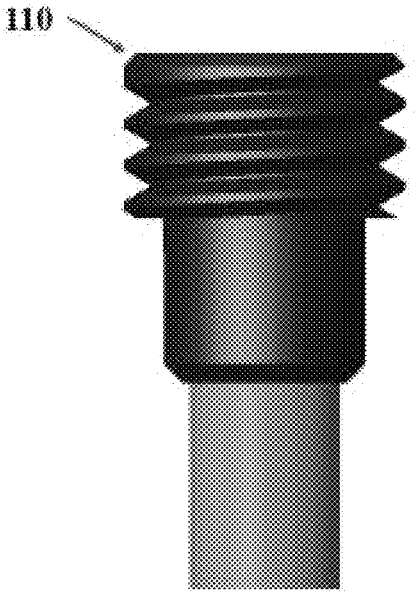
FIG. 2A depicts a front perspective view of a multi-material screw weight according to an embodiment.
Figure 2B:
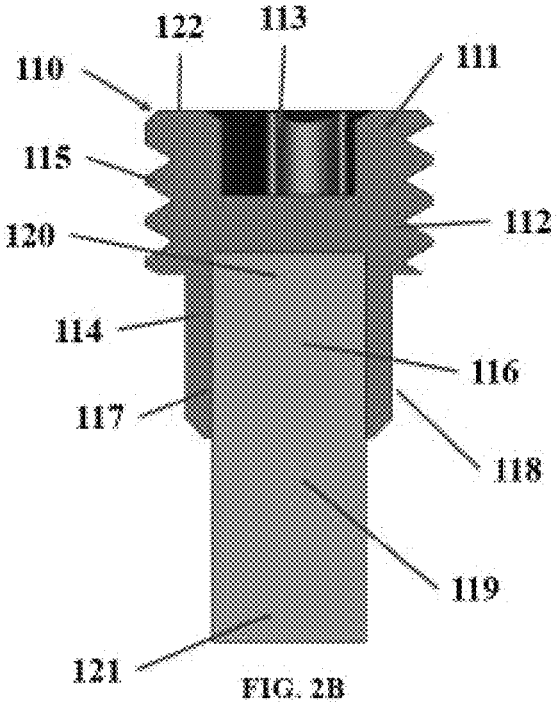
FIG. 2B depicts a cross sectional front perspective view of the weight in FIG. 2A.

The golf club head 100 or 200 as described above can comprise a weight. In one embodiment, the weight can be weight 110. The weight 110 is removeably coupled with the aperture of the club head body 101 or 201. Weight 110 can comprise a first part 111 and a second part 119. As illustrated in FIGS. 2A and 2B, the first part 111 can comprise a head 112, a body 114, a threaded region 115, and a cavity 116. The head 112 of the first part 111 can comprise a recess 113 configured to receive a fastening tool. The body 114 of the first part 111 is located underneath the head 112 of the first part 111. The second part 119 can comprise a first end 120 and a second end 121. The first end 120 of the second part 119 is configured to be removeably coupled with the cavity 116 of the first part 111. The coupling of the first end 120 and the cavity 116 can be secured together by a press fit, an adhesive, a threading, a weld, a swedge, or any other method of mechanical coupling. The first part 111 can comprise a first material with a first specific gravity or a first density less than or equal to 7.8. The second part 119 can comprise a second material with a second specific gravity or a second density greater than to 7.8. The second specific gravity or second density (herein second specific gravity) of the second material is greater than the first specific gravity or first density (herein first specific gravity) of the first material. The weight 110 can comprise a series of interchangeable second parts 119 to increase (or decrease) the overall mass of the weight 110.

The weight 110 increases the weight of the golf club head 100 or 200 to affect the center of gravity, thereby affecting the moment of inertia characteristics of the golf club head 100 or 200. The weight 110 can also be used to manipulate a golf ball flight upon impact with the golf club head 100 or 200.

1. First Part

As illustrated in FIGS. 2A and 2B, the threaded region is located near the head 112 of the first part 111. The threaded region 115 of the first part 111 can further comprise a minimum thread diameter and a maximum thread diameter. The minimum thread diameter of the threaded region 115 can range from 0.1 to 0.4 inch. In some embodiments, the minimum thread diameter of the threaded region 115 can range from 0.1 to 0.2 inch, or 0.2 to 0.4 inch. For example, the minimum thread diameter of the threaded region 115 can be 0.1, 0.15, 0.20, 0.25, 0.30, 0.35, or 0.40 inch. The maximum thread diameter of the threaded region 115 can range from 0.4 to 0.8 inch. In some embodiments, the maximum thread diameter of the threaded region 115 can range from 0.40 to 0.60 inch, or 0.60 to 0.80 inch. For example, the maximum thread diameter of the threaded region 115 can be 0.40, 0.45, 0.50, 0.55, 0.60, 0.65, 0.70, 0.75, or 0.80 inch.

As illustrated in FIGS. 2A and 2B, the threaded region 115 can comprise a length. The length of the threaded region 115 is measured perpendicular from a top surface 122 downward towards the second part 119. The length of the threaded region 115 can range from 0.1 to 0.25 inch. In some embodiments, the length of the threaded region 115 can range from 0.1 to 0.125 inch, 0.125 to 0.150 inch, 0.150 to 0.175 inch, 0.175 to 0.20 inch, 0.20 to 0.225, or 0.225 to 0.25 inch. For example, the length of the threaded region 115 can be 0.1, 0.125, 0.150, 0.175, 0.20, 0.225, or 0.25 inch.

As illustrated in FIGS. 2A and 2B, the cavity 116 of the first part 111 can comprise a cross sectional shape. The cross sectional shape can comprise a cylindrical shape, a circular shape, a rectangular shape, a triangular shape, a polygonal shape, or a trapezoidal shape. Further, the cavity 116 of the first part 111 can comprise a diameter. The diameter of the cavity 116 can range from 0.05 to 0.60 inch. In some embodiments, the diameter of the cavity 116 can range from 0.05 to 0.10 inch, 0.10 to 0.20 inch, 0.20 to 0.30 inch, 0.30 to 0.40 inch, 0.40 to 0.50 inch, 0.50 to 0.60 inch. For example, the diameter of the cavity 116 can be 0.05, 0.075, 0.10, 0.20, 0.30, 0.40, 0.50, or 0.60 inch.

Referring to FIGS. 2A and 2B, the body 114 of the first part 111 can comprise a wall thickness. The wall thickness is defined as the distance measured perpendicular from an inner surface 117 of the body 114 to an outer surface 118 of the body 114. The wall thickness of the body 114 can range from 0.015 to 0.065 inch. In some embodiments, the wall thickness of the body 114 can range from 0.015 to 0.025 inch, 0.025 to 0.035 inch, 0.035 to 0.045 inch, 0.045 to 0.055 inch, or 0.055 to 0.065 inch. For example, the wall thickness of the body 114 can be 0.015, 0.025, 0.035, 0.045, 0.055, or 0.065 inch.

The first part 111 of the weight 110 can comprise a first material. The first material may be any suitable material having a first specific gravity or density less than or equal to approximately 7.8. The first material may have a first specific gravity less than or equal to approximately 7.0, less than or equal to approximately 6.0, less than or equal to approximately 5.0, less than or equal to approximately 4.0, or less than or equal to approximately 3.0. In some embodiments, the first material may have a first specific gravity ranging from approximately 2.0 to 4.5, or 4.5 to 7.8. Specifically, the first material may have a first specific gravity of approximately 2.0, 2.8, 3.0, 3.5, 4.0, 4.5, 5.0, 5.5, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, or any other value less than or equal to approximately 7.8.

The first material may be any suitable material including steel, stainless steel, steel alloys, aluminum, titanium, vanadium, chromium, zinc, iron, aluminum, composite polymer materials, other metals, metal alloys, or any other homogeneous or heterogeneous material, wherein the specific gravity of the first material is less than or equal to approximately 7.8. The specific gravity of stainless steel is less than or equal to approximately 7.7. The specific gravity of aluminum is less than or equal to approximately 2.8. The specific gravity of titanium is less than or equal to approximately 2.6. The specific gravity of vanadium is less than or equal to approximately 6.0. The specific gravity of chromium is less than or equal to approximately 7.2. The specific gravity of zinc is less than or equal to approximately 7.2. The specific gravity of iron is less than or equal to approximately 7.13. The specific gravity of aluminum is less than or equal to approximately 2.8. The specific gravity of copper is less than or equal to approximately 8.9. The specific gravity of composite polymer is less than or equal to approximately 2.0.

The first part 111 of the weight 110 can comprise a mass. The mass of the first part 111 can range from 0.1 to 25 grams. In some embodiments, the mass of the first part 111 can range from 0.1 to 1 gram, 1 to 5 grams, 5 to 10 grams, 10 to 15 grams, 15 to 20 grams, or 20 to 25 grams. For example, the mass of the first part 111 can be 0.1, 0.5, 1, 2, 3, 4, 5, 6, 7, 8, 9, 10, 15, 20, or 25 grams.

Further, the first part 111 of the weight 110 can comprise a torque value. The torque value is the amount of twisting or rotational force needed to secure the weight 110 to the aperture 109. The torque value of the first part 111 can range from 35 to 105 in-lbs. In some embodiments, the torque of the first part 111 can range from 35 to 45 in-lbs, 45 to 55 in-lbs, 55 to 65 in-lbs, 65 to 75 in-lbs, 75 to 85 in-lbs, 85 to 95 in-lbs, or 95 to 105 in-lbs. For example, the torque of the first part 111 can be 35, 45, 50, 55, 60, 65, 70, 75, 80, 85, 90, 95, 100, 105 in-lbs.

2. Second Part

As illustrated in FIGS. 2A and 2B, the second part 119 can comprise a first end 120 and a second end 121. The second end 121 extends from the first end 120 of the second part 119 and is configured to be received by the aperture 109 of the club head body 101 or 201. Further, the first end 120 of the second part 119 can comprise a cross sectional shape complementary to the cross sectional shape of the cavity 116 as described above.

The second part 119 of the weight 110 can comprise a diameter. In some embodiments, the diameter of the second part 119 can be greater than, less than, or equal to the diameter of the cavity 116. The diameter of the second part 119 can be substantially constant along its length. The diameter of the second part 119 can range from 0.05 to 0.60 inch. In some embodiments, the diameter of the second part 119 can range from 0.05 to 0.10 inch, 0.10 to 0.20 inch, 0.20 to 0.30 inch, 0.30 to 0.40 inch, 0.40 to 0.50 inch, 0.50 to 0.60 inch. For example, the diameter of the second part 119 can be 0.05, 0.075, 0.10, 0.20, 0.30, 0.40, 0.50, or 0.60 inch.

The second part 119 of the weight 110 can comprise a length. The length is measured perpendicular from the edge of the first end 120 to the edge of the second end 121. The length of the second part 119 can range from 0.1 to 1.2 inches. In some embodiments, the length of the second part 119 can range from 0.1 to 0.3 inch, 0.3 to 0.6 inch, 0.6 to 0.9 inch, or 0.9 to 1.2 inches. For example, the length of the second part 119 can be 0.1, 0.2, 0.3, 0.4, 0.5, 0.6, 0.7, 0.8, 0.9, 1.0, 1.1, or 1.2 inches.

The second part 119 of the weight 110 can comprise a second material. The second material may be any suitable material having a second specific gravity or density greater than approximately 7.8. The second material may have a second specific gravity greater than approximately 8.0, greater than approximately 9.0, greater than approximately 10, greater than approximately 11, greater than approximately 12, greater than approximately 13, greater than approximately 14, or greater than approximately 15. In some embodiments, the second material may have a second specific gravity ranging from approximately 7.8 to 14, or 14 to 20. Specifically, the second material may have a second specific gravity of approximately 7.8, 8.0, 8.5, 9.0, 9.5, 10, 11, 12, 13, 14, 15, 16, 17, 18, 19, 20, or any other value greater than or equal to approximately 7.8.

The second material may be any suitable material including tungsten, tungsten alloys, cobalt, nickel, copper, other metals, metal alloys, or any other homogeneous or heterogeneous material, wherein the specific gravity of the second material is greater than to approximately 7.8. The specific gravity of tungsten is greater than or equal to approximately 19.22. The specific gravity of tungsten alloy is greater than or equal to approximately 8.0. The specific gravity of tungsten alloy is greater than or equal to approximately 9.0. The specific gravity of tungsten alloy is greater than or equal to approximately 10. The specific gravity of tungsten alloy is greater than or equal to approximately 11. The specific gravity of cobalt is greater than or equal to approximately 8.7. The specific gravity of nickel is greater than or equal to approximately 8.9. The specific gravity of copper is less than or equal to approximately 8.9.

The second part 119 of the weight 110 can comprise a mass. The mass of the second part 119 can range from 0.1 to 50 grams. In some embodiments, the mass of the second part 119 can range from 0.1 to 1 gram, 1 to 5 grams, 5 to 10 grams, 10 to 15 grams, 15 to 20 grams, 20 to 25 grams, 25 to 30 grams, 30 to 40 grams, or 40 to 50 grams. For example, the mass of the second part 119 can be 0.1, 0.5, 1, 2, 3, 4, 5, 6, 7, 8, 9, 10, 15, 20, 25, 30, 35, 40, 45, or 50 grams.

Figure 3A:
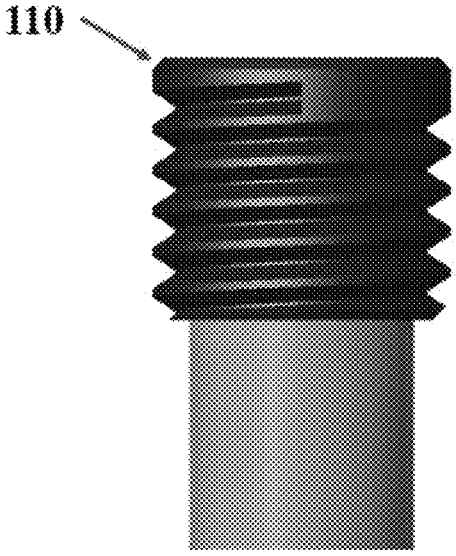
FIG. 3A depicts a front perspective view of a multi-material screw weight according to another embodiment.
Figure 3B:
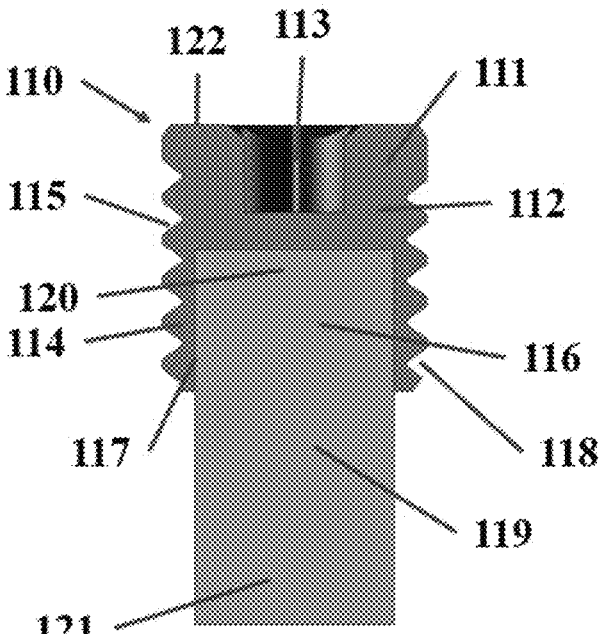
FIG. 3B depicts a cross sectional front perspective view of the weight in FIG. 3A.

According to another embodiment as illustrated in FIGS. 3A and 3B, the first part 111 comprises a threaded region 115 extending from the head 112 to the body 114. In this embodiment, the other features of the first part 111 and the second part 119 are similar to the first part 111 and second part 119 described above. In this embodiment, the increased length of the threaded region 115 allows for more thread engagement with the aperture 109. With more thread engagement, the weight 110 is more secure to the aperture 109 during use.

Figure 4A:
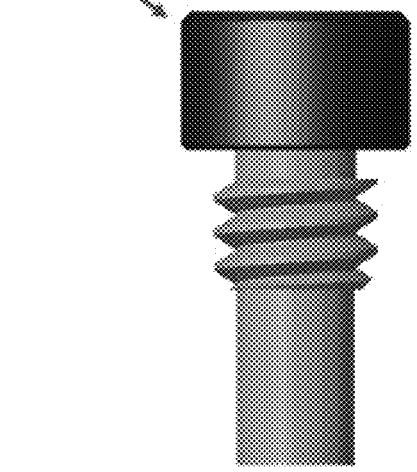
FIG. 4A depicts a front perspective view of a multi-material screw weight according to another embodiment.
Figure 4B:
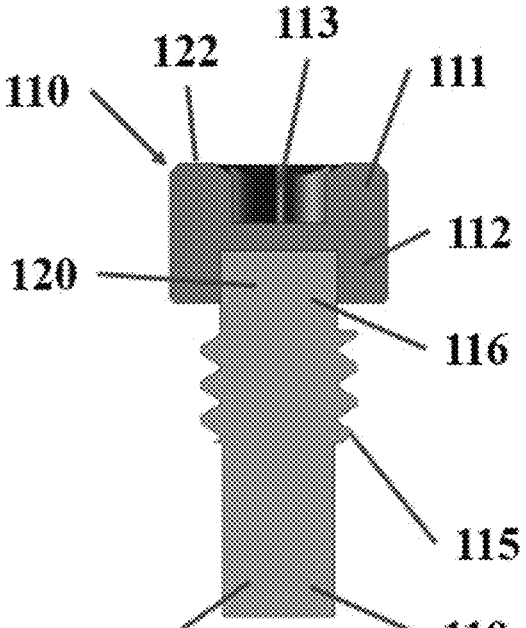
FIG. 4B depicts a cross sectional front perspective view of the weight in FIG. 4A.

According to another embodiment as illustrated in FIGS. 4A and 4B, the second part 119 can comprise a threaded region 115. In some embodiments, the threaded region 115 in this embodiment can be located near the first end 120 or located near the second end 121 of the second part 119. In some embodiments, the threaded region 115 can extend the entire length of the second part 119 from the first end 120 to the second end 121. The first part 111 may or may not comprise a threaded region 115 or a body 114. In this embodiment, the other features of the first part 111 and the second part 119 are similar to the first part 111 and second part 119 described above.

The weight 110 having the first part 111 with a first low density material separate from the second part 119 with a second high density material allows for the weight 110 to have multiple advantages. Having two separate parts allows for easier adjustability of the weight of the golf club head 100 or 200, reduces the manufacturing costs of machining higher density materials, and increases production capabilities. Machining threads on a first low density material is easier and faster than machining threads on a second high density material. Since the second high density material is more brittle than the first low density material, the second high density material tends to see cracking during the threading of the weight 110 to the club head body 101 or 201. Having the first low density material with the threading and the second high density material with the majority of the weight distribution allows for a series of interchangeable second parts 119 to increase (or decrease) the weight to specific integers of weight and reduces the stockpile of inventory that the supplier has to manufacture. In addition, the first low density material is easier to paint and provides a stockpile of inventory of weights with a consistent surface finish and coloring scheme, and provides durability to the threads because the threads comprise the more durable, less brittle first low density material.

The weight 110 with the first part 111 including the threaded region 115 on the head 112 allows for a greater wall thickness of the first part 111. Having a greater wall thickness provides more structural rigidity during the torqueing of the weight 110 to the club head body 101 or 201. In addition, the threaded region 115 on the head 112 allows for a greater thread diameter to be use providing more material thickness at the threaded region 115. A greater material thickness provides a stress relief at the threaded region 115 during engagement with the aperture 107.

Clause 1: A weight for a golf club head comprising a first part comprising a head, a body, a threaded region, a cavity, and a first material having a first specific gravity, a second part comprising a first end, a second end, and a second material having a second specific gravity, the first end of the second part is configured to be removeably coupled to the cavity of the first part, the head of the first part comprising a recess wherein the recess of the head is configured to receive a fastener tool, wherein the second material comprises a higher density than the first material.

Clause 2. The weight of claim 1, wherein the first part has a minimum wall thickness of 0.025 inch.

Clause 3. The weight of claim 1, wherein the threaded region comprises a length and the length of the threaded region ranges from 0.10 inch to 0.25 inch.

Clause 4. The weight of claim 1, wherein the first material of the first part comprises a specific gravity less than or equal to 7.8.

Clause 5. The weight of claim 1, wherein the second material of the second part comprises a second specific gravity greater than 7.8.

Clause 6. The weight of claim 1, wherein the first end of the second part creates a press fit within the cavity of the first part.

Clause 7. The weight of claim 1, wherein the second part comprises a circular shape, a triangular shape, a square shape, a rectangular shape, a pentagonal shape, a hexagonal shape, or a polygonal shape.

Clause 8. The weight of claim 1, wherein the first material comprises a steel material and a first specific gravity less than or equal to 7.8, the second material comprises a tungsten material and a second specific gravity greater than 7.8.

Clause 9. The weight of claim 1, wherein the first material comprises a steel material, and a first specific gravity less than or equal to 7.8, the second material comprises a tungsten alloy material and a second specific gravity greater than 7.8.

Clause 10. The weight of claim 1, wherein the first part comprises a aluminum material, a first specific gravity less than or equal to 7.8, the second part comprises, a tungsten material, a second specific gravity greater than to 7.8.

Clause 11. The weight of claim 1, wherein the threaded region is located at the head of the first part, head and body of the first part, and or only second part.

Clause 12. A golf club head comprising, a club head body having a striking face, a rear opposite the striking face, a sole, a top opposite the sole, a heel region, a toe region, a hosel, and an aperture, a weight comprising a first part and a second part, the first part comprising a head, a body, a threaded region, a cavity, and a first material having a first specific gravity, the second part comprising a first end, a second end, and a second material having a second specific gravity, the first end of the second part is configured to be removeably coupled to the cavity of the first part, the head of the first part comprising a recess wherein the recess of the head is configured to receive a fastener tool, wherein the second material comprises a higher density than the first material.

Clause 13. The golf club head of claim 12, wherein the weight is torqued to the aperture to a value no less than 45 in-lbs.

Clause 14. The golf club head of claim 12, wherein the first material of the first part comprises a specific gravity less than or equal to 7.8.

Clause 15. The golf club head of claim 12, wherein the second material of the second part comprises a second specific gravity greater than 7.8.

Clause 16. The golf club head of claim 12, wherein the first end of the second part creates a press fit within the cavity of the first part.

Clause 17. The golf club head of claim 12, wherein the first material comprises, a steel material and a first specific gravity less than or equal to 7.8, the second material comprises a tungsten material and a second specific gravity greater than 7.8.

Clause 18. The golf club head of claim 12, wherein the first part comprises a aluminum material, a first specific gravity less than or equal to 7.8, the second part comprises, a tungsten material, a second specific gravity greater than 7.8.

Clause 19. A method comprising providing a weight, wherein providing the weight comprises, providing a first part, and providing a second part, wherein the weight is configured to be insertable into a golf club head, the golf club head comprises a golf club head body comprising a striking face, a rear opposite the striking face, a top, a sole, a heel region, a toe region, a hosel, and a aperture, the first part comprises a steel material, a head, a threaded region, and a cavity, the second part comprises, a tungsten material, a first end, and a second end, the cavity is configured to be coupled to the first end, the head is configured to receive a fastener tool, and the weight is removeably coupled to the aperture.

Clause 20. The method of claim 19 comprising providing the golf club head, providing the weight, inserting the second part into the first part, and coupling the weight into the golf club head with the fastener tool, wherein inserting can be pressfit of epoxied.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following claims.

The invention claimed is:

1. A weight for a golf club head consisting of:

a first part comprising a head including a recess and a threaded region, a cavity, and a first material having a first specific gravity; and a second part comprising a first end, a second end, and a second material having a second specific gravity;

wherein the second part comprises a second part diameter and a second part length extending between the first end and the second end; and wherein the second part diameter is constant along the second part length;

wherein the threaded region extends an entire length of the head; the threaded region comprises a threaded region length; and the threaded region length ranges from 0.10 inch to 0.25 inch;

wherein the threaded region comprises a maximum thread diameter in a range of 0.4 inch to 0.8 inch;

wherein the cavity of the first part comprises a cavity cross-sectional shape; and wherein the second part comprises a second part cross-sectional shape; and wherein the cavity cross-sectional shape is complementary to the second part cross-sectional shape;

wherein the first end of the second part is configured to be removably coupled with the cavity of the first part;

wherein the second part is secured within the first part by a press fit, wherein the second part diameter is greater than a diameter of the cavity of the first part;

wherein the second part is selected from a plurality of second parts;

wherein each second part of the plurality of second parts comprises a different weight;

wherein the second part is devoid of a threaded region;

wherein the recess of the head is configured to receive a fastener tool;

wherein the second specific gravity is greater than the first specific gravity;

wherein:

the first material comprises:

a steel material; and a first specific gravity less than or equal to 7.8;

the second material comprises:

a tungsten material; and a second specific gravity greater than 7.8.

2. The weight of claim 1, wherein:

the first part has a minimum wall thickness of 0.025 inch.

3. The weight of claim 1, wherein:

the first material of the first part comprises a specific gravity less than or equal to 7.8.

4. The weight of claim 1, wherein:

the second material of the second part comprises a second specific gravity greater than 7.8.

5. The weight of claim 1, wherein:

the second part comprises a circular shape, a triangular shape, a square shape, a rectangular shape, a pentagonal shape, a hexagonal shape, or a polygonal shape.

6. A golf club head comprising:

a club head body having a striking face, a rear opposite the striking face, a sole, a top opposite the sole, a heel region, a toe region, a hosel, and an aperture;

a weight consisting of:

a first part comprising a head including a recess and a threaded region, a cavity, and a first material having a first specific gravity; and a second part comprising a first end, a second end, and a second material having a second specific gravity;

wherein the second part comprises a second part diameter and a length extending between the first end and the second end; and wherein the second part diameter is constant along its length;

wherein the threaded region extends an entire length of the head;

the threaded region comprises a length; and the length of the threaded region ranges from 0.10 inch to 0.25 inch;

wherein the threaded region comprises a maximum thread diameter in a range of 0.4 inch to 0.8 inch;

wherein the cavity of the first part comprises a cavity cross-sectional shape; and wherein the second part comprises a second part cross-sectional shape; and wherein the cavity cross-sectional shape is complementary to the second part cross-sectional shape;

wherein the first end of the second part is configured to be removably coupled with the cavity of the first part;

wherein the second part is secured within the first part by a press fit, wherein a diameter of the first end of the second part is greater than a diameter of the cavity of the first part;

wherein the second part is selected from a plurality of second parts;

wherein each second part of the plurality of second parts comprises a different weight;

wherein the second part is devoid of a threaded region;

wherein the recess of the head is configured to receive a fastener tool;

wherein the second specific gravity is greater than the first specific gravity;

wherein the weight is removably coupled to the aperture of the club head body;

wherein:

the first material comprises:

a steel material; and a first specific gravity less than or equal to 7.8;

the second material comprises:

a tungsten material; and a second specific gravity greater than 7.8.

7. The golf club head of claim 6, wherein:

the weight is torqued to the aperture to a value no less than 45 in-lbs.

8. The golf club head of claim 6, wherein:

the first material of the first part comprises a specific gravity less than or equal to 7.8.

9. The golf club head of claim 6, wherein:

the second material of the second part comprises a second specific gravity greater than 7.8.

10. A method comprising:

providing a weight, wherein providing the weight consists of:

providing a first part; and providing a second part;

wherein:

the weight is configured to be insertable into a golf club head;

the golf club head comprises:

a golf club head body comprising a striking face, a rear opposite the striking face, a top, a sole, a heel region, a toe region, a hosel, and an aperture;

the first part comprises:

a steel material;

a head;

a threaded region;

a cavity;

a recess;

the second part comprises:

a tungsten material;

a first end; and a second end;

a second part diameter;

a length extending between the first end and the second end;

wherein the second part diameter is constant along its length;

the threaded region extends an entire length of the head;

the threaded region comprises a length; and the length of the threaded region ranges from 0.10 inch to 0.25 inch;

wherein the threaded region comprises a maximum thread diameter in a range of 0.4 inch to 0.8 inch;

wherein the cavity of the first part comprises a cavity cross-sectional shape; and wherein the first end of the second part comprises a second part cross-sectional shape; and wherein the cavity cross-sectional shape is complementary to the second part cross-sectional shape;

the second part is secured within the first part by a press fit, wherein the second part diameter is greater than a diameter of the cavity;

wherein the second part is selected from a plurality of second parts;

wherein each second part of the plurality of second parts comprises a different weight;

wherein the second part is devoid of a threaded region; and the weight is removably coupled to the aperture;

wherein the recess of the head is configured to receive a fastener tool.

11. The method of claim 10 comprising:

providing the golf club head;

providing the weight;

inserting the second part into the first part; and coupling the weight to the golf club head with the fastener tool, wherein the weight is pressed or epoxied.

* * * * *